US006202730B1

(12) United States Patent
Lee

(10) Patent No.: US 6,202,730 B1
(45) Date of Patent: Mar. 20, 2001

(54) VERTICAL WINDOW BLIND CARRIER

(76) Inventor: Paul Lee, 12839 Sky Knoll, Houston, TX (US) 77082

( * ) Notice: Subject to any disclaimer, the term of this patent is extended or adjusted under 35 U.S.C. 154(b) by 0 days.

(21) Appl. No.: 09/047,794

(22) Filed: Mar. 25, 1998

(51) Int. Cl.[7] ..... E06B 9/30

(52) U.S. Cl. ..... 160/168.1 V; 160/176.1 V; 160/178.2 R

(58) Field of Search ..... 160/168.1 V, 167 V, 160/173 V, 174 V, 176.1 V, 177 V, 178.1 V, 178.2 R

(56) References Cited

U.S. PATENT DOCUMENTS 2,192,002 * 2/1940 Bond et al. ..... 160/178.2 R X
2,996,115 * 8/1961 Klenz ..... 160/168.1 V
4,102,381 * 7/1978 Bratschi ..... 160/176.1 V X
4,628,981 * 12/1986 Ciriaci ..... 160/176.1 V
4,648,436 * 3/1987 Oskam ..... 160/168.1 V
4,802,522 * 2/1989 Anderson ..... 160/168.1 V
5,257,811 * 11/1993 Biba ..... 160/168.1 V
5,316,066 * 5/1994 Rapp et al. ..... 160/178.2 R

* cited by examiner

*Primary Examiner*—Bruce A. Lev
(74) *Attorney, Agent, or Firm*—Alan J. Atkinson

(57) ABSTRACT

A carrier for supporting vertical blinds used in covering window and door openings. The carrier has a clip with an inner space for permitting a vane to translate relative to the clip as the vane rotates to close the opening. The clip inner space can be U-shaped to provide a self-centering function for the vane. A horizontal wing is attached to the clip to provide a rotating force against the end vane. By providing this force, gaps between the vertical vanes are eliminated so that the opening is completely sealed. The end vane can overlap the blind control wand to eliminate gaps between the wand and end vane. A cord lock can automatically prevent loosening of the end vane relative to the adjacent vane.

14 Claims, 2 Drawing Sheets

VERTICAL WINDOW BLIND CARRIER

BACKGROUND OF THE INVENTION

The present invention relates to the field of vertical blinds for covering window and door openings. More particularly, the present invention relates to an improved vane carrier for positioning vertical blind vanes.

Blinds are drawn across openings to provide privacy, thermal insulation, and light sealing properties. For large openings, vertical vanes are drawn horizontally across the opening. The vertical vanes are hung from a top rail and hang downwardly due to gravity. When stored on one side of the opening, each vane is oriented perpendicular to the wall or opening. The vanes are drawn across the opening with a cord so that the vanes hand in the same orientation perpendicular to the opening. The vanes are then rotated with a baton, wand or cord operated mechanism to rotate each vane about a center axis so that the vanes are substantially parallel to the opening. In this position, the side edges of each vane overlaps adjacent vanes and the opening is concealed by the overlapping vanes.

Vane carriers located at the blind top are moveable along a rail track for transporting the vanes horizontally across the opening, and for permitting rotation of the vanes relative to the opening. The vane carriers are constructed to permit the attachment and detachment of the vertical vanes, and are typically formed with plastic or other light materials to reduce the overall blind weight. The vane carriers include a clip for insertion through an aperture in the upper vane end. The clip engages the vane aperture and holds the vane body as the vane is transported horizontally across the opening and is rotated about the vane axis relative to the opening.

The baton for rotating the vanes typically hangs vertically along one side of the blind. A gap typically exists between the baton and the adjacent end vane, and this gap permits light to filter through the blind. Although each interior vane is contacted by adjacent vanes on each side, the end vane closest to the baton only has contact with an adjacent vane on one side. The free vane edge is not contacted by an adjacent vane, and does not have the retaining force necessary to retain such vane parallel to the opening. Accordingly, gaps can exist between the end vane and the adjacent vane, thereby lessening the light sealing effectiveness of the entire blind.

For these reasons, a need exists for an improved blind capable of sealing gaps between the end vanes and an adjacent vane, and for sealing the gaps between the end vane and a baton operating the vanes.

SUMMARY OF THE INVENTION

The present invention provides an improved apparatus for covering a window or door opening with vertical vanes to block light and air movement. The invention comprises a carrier body engaged with a blind head rail for horizontal and rotational movement relative to the head rail, and a clip attached to the carrier body for permitting the vane to move in a substantially translational direction relative to the clip. A wing can be attached to the carrier body or the clip for selectively contacting an end vane and for imparting a rotational force against the end vane.

In one embodiment of the invention, a head rail extends over the opening, and a plurality of vertically extending vanes are moveable in rotational and translational directions relative to the head rail. A control means rotates the vanes about the longitudinal axis for each vane, and a carrier body defines an interior space for retaining the end vane while permitting the end vane to translate relative to the carrier body.

DESCRIPTION OF THE PREFERRED EMBODIMENTS

Figure 1:
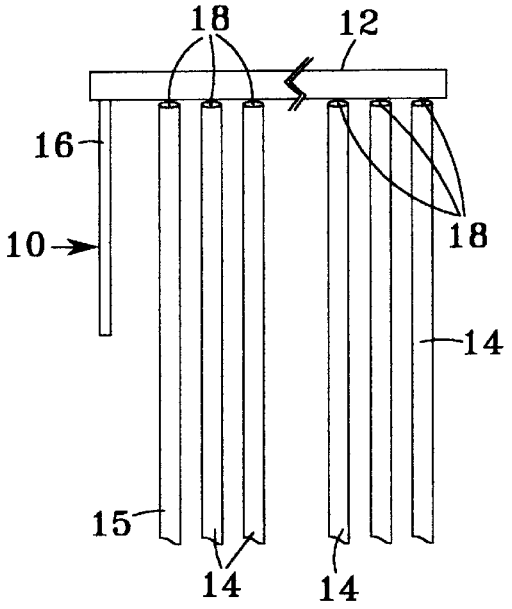
FIG. 1 illustrates a blind having vertical vanes for covering an opening.

The invention improves blind coverings by eliminating gaps between the end vane in a vertical blind and between the blind wand or baton and the blind end vane. Referring to FIG. 1, vertical blind 10 generally comprises head rail 12, vertical extending vanes 14, end vane 15, and a control means such as baton or wand 16. Carrier bodies 18 are engaged between head rail 12 and vanes 14 (and end vane 15) for supporting vanes 14 while permitting translational and rotational movement of vanes 14. Wand 16 can be engaged with carrier bodies 18 so that wand 16 is pulled horizontally to translate vanes 14 across the opening, or can further comprise a cord or chain operated mechanism which moves vanes 14 across the opening.

Figure 2:
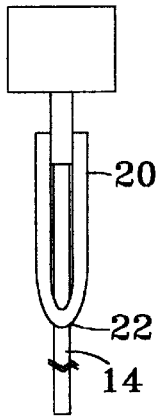
FIG. 2 illustrates a conventional vane carrier clip.

Referring to FIG. 2, a conventional carrier clip 20 is illustrated for engaging an aperture 22 in an upper end of vane 14. Clip 20 has an opening 24 which permits attachment and detachment of aperture 22 with clip 20. When a force is exerted against an outer edge of vane 14, the force generates a torque acting against clip 20 which can break clip 20. Additionally, such a force can open gaps between adjacent vanes 14 which permit the undesirable passage of light through blind 10.

Figure 3:
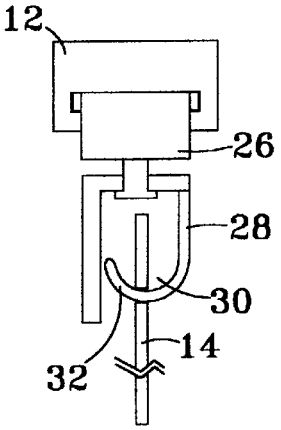
FIG. 3 illustrates one embodiment of a U-shaped carrier clip.
Figure 4:
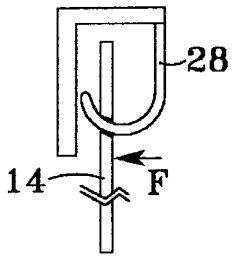
FIG. 4 illustrates the position of a vane relative to the carrier clip after a force has acted against the vane.

FIG. 3 illustrates one embodiment of the invention wherein carrier body 26 is engaged with head rail 12 for translational and rotational movement therebetween. Clip 28 is attached to carrier body 26 and defines an interior space 30 for retaining vane 15. Interior space 30 permits translational movement of vane 15 relative to clip 28 as described below. In a preferred embodiment of the invention, lower clip member 32 is U-shaped to provide a self-centering function for vane 15. If a force F pushes against vane 15 as shown in FIG. 4, interior space 30 permits translational movement of vane 15 relative to clip 28. Such allowance for movement reduces damaging torques exerted against clip 28 and carrier body 26 and further permits more effective light sealing action by vane 15. When force F is released, the U-shaped configuration of lower clip member 32 permits vane 15 to gravitate toward the center of interior space 30 so that vane 15 returns to the original orientation relative to head rail 12 and to adjacent vanes 15.

Figure 5:
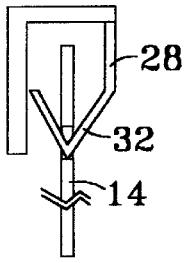
FIG. 5 illustrates an embodiment of a V-shaped carrier clip.

FIG. 5 illustrates a different embodiment of lower clip member 32 having a V-shaped configuration. In other embodiments of the invention, the lower clip member can be straight, irregular, or other shapes sufficient to permit substantially translational movement of vane 15 relative to clip 28.

Figure 7:
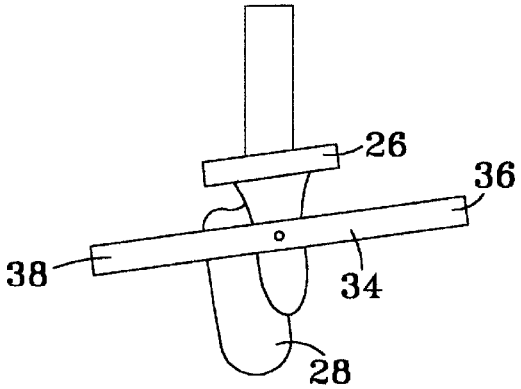
FIGS. 6 and 7 illustrate a wing attached to a carrier body for generating a closing force against a vertical vane.
Figure 6:
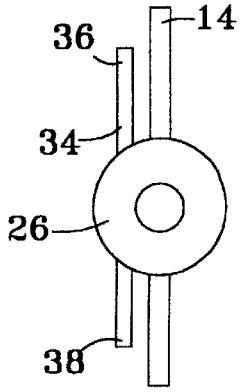

FIGS. 6 and 7 illustrates another embodiment of the invention wherein wing 34 is attached to carrier body 26. Wing 34 is illustrated as a substantially horizontal bar having first end 36 and second end 38. When carrier body 26 is rotated in one direction, wing first end 36 will contact an outer edge of vane 15 and will impart a rotational force against vane 15. When carrier body 26 is rotated in the opposing direction, wing second end 38 will impart a rotational force against the opposing outer edge of vane 15. The rotational force exerted by wing 34 against vane 15 uniquely closes vane 15 against adjacent vanes 14 or against wand 16, thereby providing a more effective light seal than is available with conventional blind systems. The structure and configuration of wing 34 can be shaped and formed in many different ways sufficient to impart a force or torque against vane 15.

Wing 34 is particularly useful in providing for full rotation of end vane 15 relative to adjacent vane 14. Because vane 15 is only contacted along one edge and is unsupported along one edge, vane 15 does not always provide an effective cover for light or air movement in conventional vertical blinds. Wing 34 provides a rotational force or torque which rotates end vane 15 against adjacent vane 14, thereby providing a tight seal therebetween. Additionally, wing 34 permits full rotation of end vane 15 which also seals the gap typically found between end vane 15 and wand 16.

The unique combination of wing 34 and clip interior space 30 cooperate to provide for enhanced light sealing and closure capabilities. When wing 34 is rotated with carrier body 26 to contact wing first end 36 against end vane 15, vane 15 can rotate within clip interior space 30 and can translate within clip interior space to provide for mechanical movement of end vane 15 relative to wand 16 and to adjacent vane 14. When carrier body 26 is rotated to the original orientation, end vane 15 gravitates toward the center of clip interior space 30 due to the lowered center provided by lower clip member 32.

Although carrier body 26 and clip 28 are described as separate components, other embodiments of the invention can integrate these components into a single component. In various embodiments of the invention, wing 34 can be attached to carrier body 26 or to clip 28. Different combinations of manual operation or mechanical control means can translate carrier body 26 and vanes 14 and 15 across head rail 12, or can rotate such components relative to head rail 12.

Figure 8:
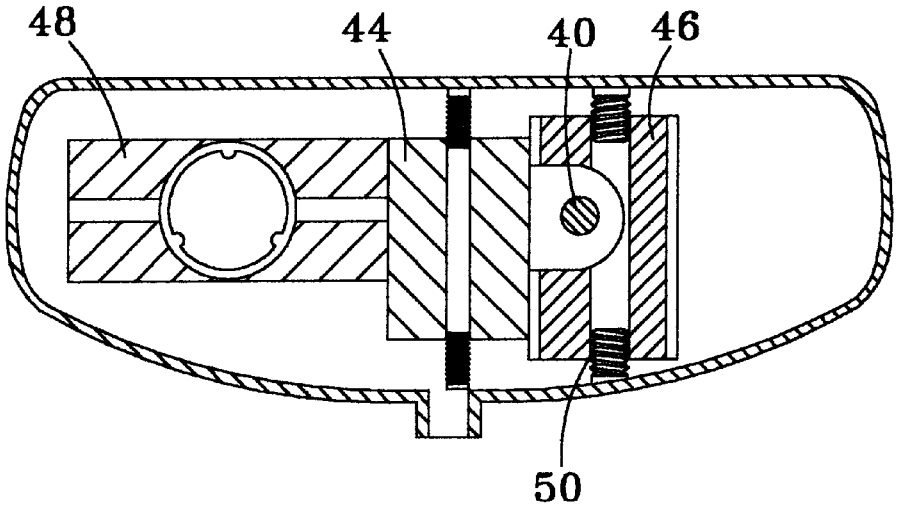
FIGS. 8 and 9 illustrate a cord lock mechanism for securing the end vane against the adjacent vane.
Figure 9:
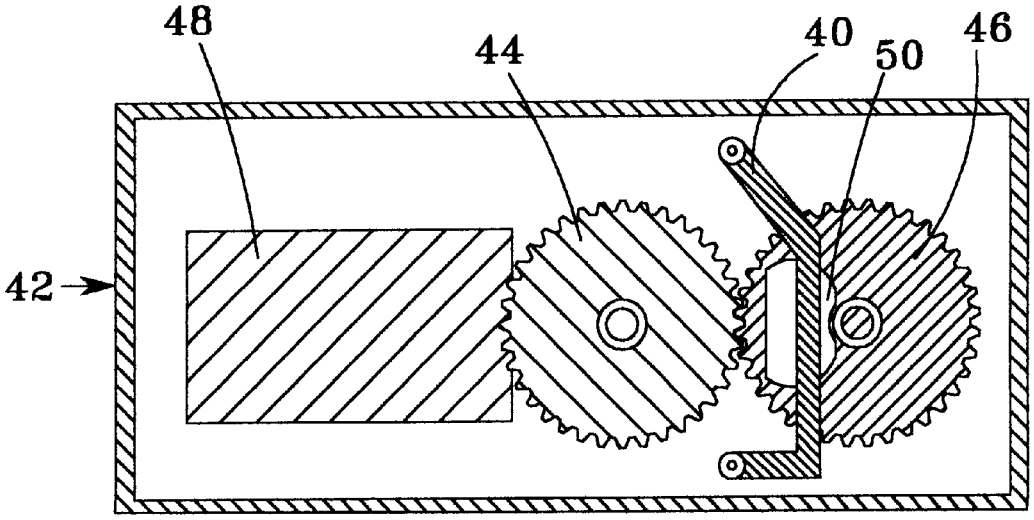

FIGS. 8 and 9 illustrate a feature of the invention for retaining end vane 15 in rotation against the adjacent vane 14. Cord 40 is operable to rotate vane 15 into engagement with adjacent vane 14 to provide the closure described above. Cord 40 can be moved with a conventional chain pull, cord pull, or wand operated mechanism retaining cord 40 within the interior body of the wand. If the tension on cord 40 is released, vane 15 may rotate slightly in a counter direction and lose the closure previously obtained. This occurs because conventional gears provide for slight relative movement, and this slack can release tension against cord 40. Cord lock mechanism 42 automatically prevents such counter-rotation by selectively trapping cord 40 between rotating gears 44 and 46. Rotation of pinion gear 48 causes gear 44 to rotate in a counterclockwise direction, thereby causing gear 46 to rotate at the same rate in a clockwise direction. Cord 40 is initially threaded through aperture 50 in gear 46, and is free to move therethrough. When gears 44 and 46 counter-rotate, aperture 50 is rotated away from gear 44 and the side of gear 46 pinches cord 40 against gear 44 to prevent further movement of cord 40. When pinion gear is rotated in the opposite direction, gears 44 and 46 rotate in opposite directions to reopen aperture 50 and to free cord 40.

The rotation of gears 44 and 46 can be operated in the opposite directions to accomplish the function of locking cord 40 against further movement. In the embodiment of the invention illustrated, gears 44 and 46 automatically cooperate at the same rate to selectively lock cord 40. Although FIGS. 8 and 9 illustrate one embodiment of this inventive feature, it will be appreciated that different components and configurations can be assembled to selectively lock cord 40 from further movement.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus engaged with a head rail for carrying a vertical vane in a blind for covering an opening, comprising:

a carrier body engaged with the head rail for horizontal and rotatable movement relative to the head rail;

a clip attached to said carrier body for engagement with the vertical vane, wherein said clip defines an interior space for permitting the vane to move in a substantially translational direction relative to said clip; and a wing attached to said carrier body for selectively contacting the vane as said carrier body rotates relative to said head rail.

2. An apparatus as recited in claim 1, wherein said clip includes a substantially horizontal member for engagement with said vane and for permitting rotational movement of the vane relative to said clip.

3. An apparatus as recited in claim 1, wherein said horizontal member has a center lower than the sides of said horizontal member so that gravity tends to move the vane toward said horizontal member center.

4. An apparatus as recited in claim 3, wherein said horizontal member is U-shaped.

5. An apparatus as recited in claim 3, wherein said horizontal member is V-shaped.

6. An apparatus as recited in claim 1, wherein said wing is attached to said clip.

7. An apparatus as recited in claim 1, wherein said wing comprises a substantially horizontal bar having opposing ends extending outwardly from said carrier body, wherein each end is capable of selectively contacting the vane to exert a rotational force against the vane.

8. An apparatus engaged with a head rail for carrying a vertical vane in a blind for covering an opening, comprising:

a carrier body engaged with the head rail for horizontal and rotatable movement relative to the head rail;

a cord engaged with said carrier body and operable to move said carrier body; and a cord lock for selective engagement with said cord to prevent movement of said carrier body; and a wing attached to said carrier body for selectively contacting the vane as said carrier body and engaged vane rotate relative to the head rail.

9. An apparatus as recited in claim 8, wherein said wing has opposing ends extending outwardly from said carrier body, and wherein each end is capable of selectively contacting the vane to provide a rotational force against the vane.

10. An apparatus as recited in claim 8, further comprising a clip attached to said carrier body for engagement with the vertical vane, wherein said clip defines an interior space for permitting the vane to move in a substantially translational direction relative to said clip.

11. An apparatus as recited in claim 10, wherein said wing is attached to said clip.

12. A blind for covering an opening, comprising:

a head rail extending over the opening;

a plurality of vertically extending vanes moveable in rotational and translational directions relative to said head rail to cover the opening, wherein one of said vanes comprises an end vane;

control means for rotating said vanes about the longitudinal axis extending through each vane;

a carrier body engaged with said head rail for translational and rotational movement relative to said head rail, wherein said carrier body further defines an interior space for retaining said end vane while permitting said end vane to translate relative to said carrier body as said carrier body rotates relative to said head rail and a wing attached to said carrier body for selectively contacting said end vane as said carrier body rotates relative to said head rail.

13. A blind as recited in claim 12, wherein said wing comprises a substantially horizontal bar.

14. An apparatus as recited in claim 12, further comprising a cord engaged with the vanes for selectively rotating the vanes, and further comprising a cord lock operable to selectively prevent movement of said cord.

* * * * *